United States Patent [19]

Shieh

[11] Patent Number: 4,989,856

[45] Date of Patent: Feb. 5, 1991

[54] SAFETY ROCKING HORSE

[76] Inventor: Kuo-Chen Shieh, No. 10, Alley 1, Lane 92, Kwangchow Street, Taipei City, Taiwan

[21] Appl. No.: 467,175

[22] Filed: Jan. 19, 1990

[51] Int. Cl.[5] ..... A63G 17/00

[52] U.S. Cl. ..... 272/52

[58] Field of Search ..... 272/52, 52.5, 53.1, 272/53.2; 280/1.175, 1.188

[56] References Cited

U.S. PATENT DOCUMENTS 256,390 4/1882 Shepardson ..... 272/52.5
1,950,338 3/1934 Zivkovic ..... 280/1.175
3,848,869 11/1974 Morrison ..... 272/52.5

FOREIGN PATENT DOCUMENTS 617010 7/1935 Fed. Rep. of Germany ..... 272/52
30428 10/1921 Denmark ..... 272/52

*Primary Examiner*—Richard E. Chilcot, Jr.
*Attorney, Agent, or Firm*—Bacon & Thomas

[57] ABSTRACT

A rocking horse provided with a buffer assembly that includes a wheeled axle which may be selectively engaged within upper and lower grooves formed in the front portions of the rocker arms to prevent the horse from rolling over during use and permitting the horse to move forward along a support surface.

1 Claim, 4 Drawing Sheets

SAFETY ROCKING HORSE

BACKGROUND OF THE INVENTION

Due to rapid growth of industry and economics, value is placed on practical and safe devices, particularly devices in the form of toys of children. If a toy design is not both novel and safe, it will not have much commercial interest. For example, an ordinary rocking horse formed of wood may be of different forms and appearances, but its basic function is limited to a rocking motion in a stationary position. Alternatively, a wooden horse may be provided with four rollers on its legs so that the horse can be permitted to roll on a support surface in the manner of a toy car. Known horses of these types have several disadvantages.

First, a conventional rocking horse can swing or rock back and forth in a stationary location. However, if the rocking motion imparted by the user is too great, the horse will roll over and throw the user onto the ground. A rocking horse of this type does not provide a sense of security in use and is very monotonous and unsatisfying since its movement is limited to rocking in a stationary location.

Second, it is known to support a toy horse on a metal frame which does not roll over during use, thereby providing a greater sense of security to the user. However, this type of horse is also unsatisfying since movement in use is confined to a stationary location.

Third, a conventional toy horse supported on wheels to permit the horse to roll on a surface like a toy car may not be of the proper height for the user. If the legs of a child using the horse are too short to reach the ground for propelling the horse in a forward direction, an adult is required to assist the child by pushing the child and horse in a forward direction.

SUMMARY OF THE INVENTION

The primary object of the present invention is to provide an improved wooden rocking horse which is capable of both rocking back and forth in a stationary location and also moving forward along a support surface to provide a unique and entertaining function.

Another object of the invention is to provide a structure whereby a user may impart a back and forth rocking motion in a stationary location or a forward movement along a support surface.

A further object of the invention is to provide a wooden rocking horse that will not turn over during use and thereby impart a sense of security to the user.

The invention provides a structure for a wooden rocking horse that is safe in use and is capable of forward and backward rocking motion in a stationary location and also rolling movement in a forward direction. The horse includes a buffer assembly and two pairs of upper and lower spaced grooves provided at the front ends of the rocker arms forming the base of the horse. The buffer assembly includes an elastic rope, an axle and a pair of spaced wheels supported on the axle. The axle may be selectively engaged within either the upper pair of grooves, wherein it is removed from contact with the support surface, or the lower pair of grooves, wherein it may engage the support surface to prevent the center line of the horse from exceeding its declination line during rocking of the horse by the user in order to prevent the horse from rolling or turning over. When the axle is supported in the lower grooves, the wheels permit the horse to roll forward along the support surface, thereby providing another function in addition to the back and forth rocking motion in a stationary location.

DETAILED DESCRIPTION OF THE PREFERRED EMBODIMENT

Figure 1:
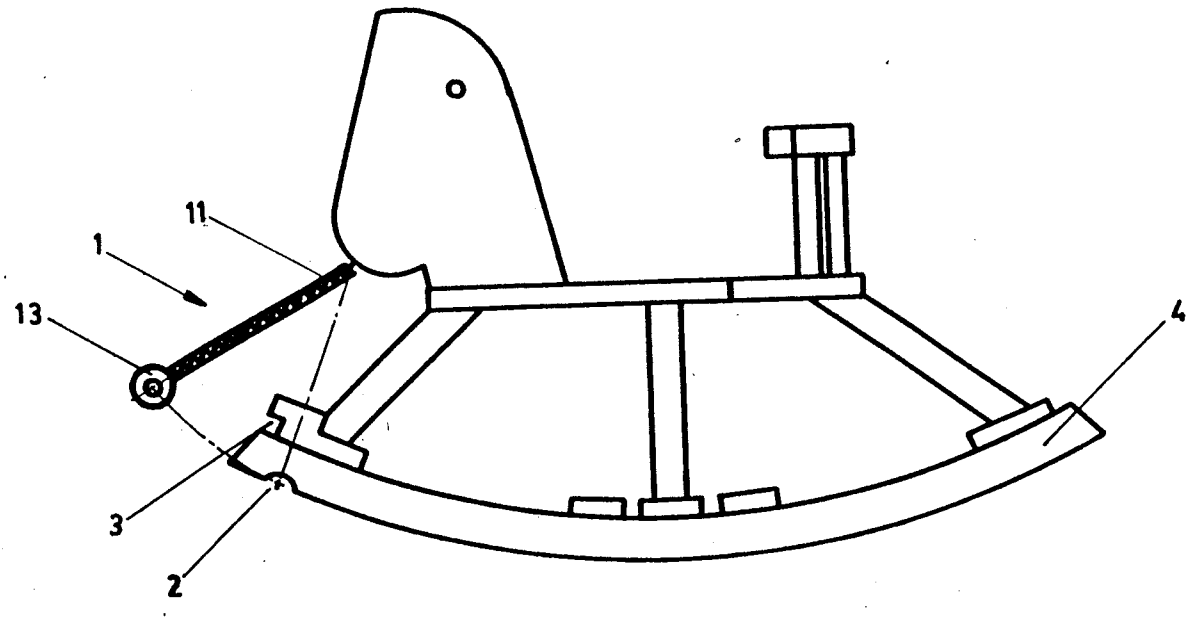
FIG. 1 is a side elevational view of a rocking horse according to the invention.
Figure 2:
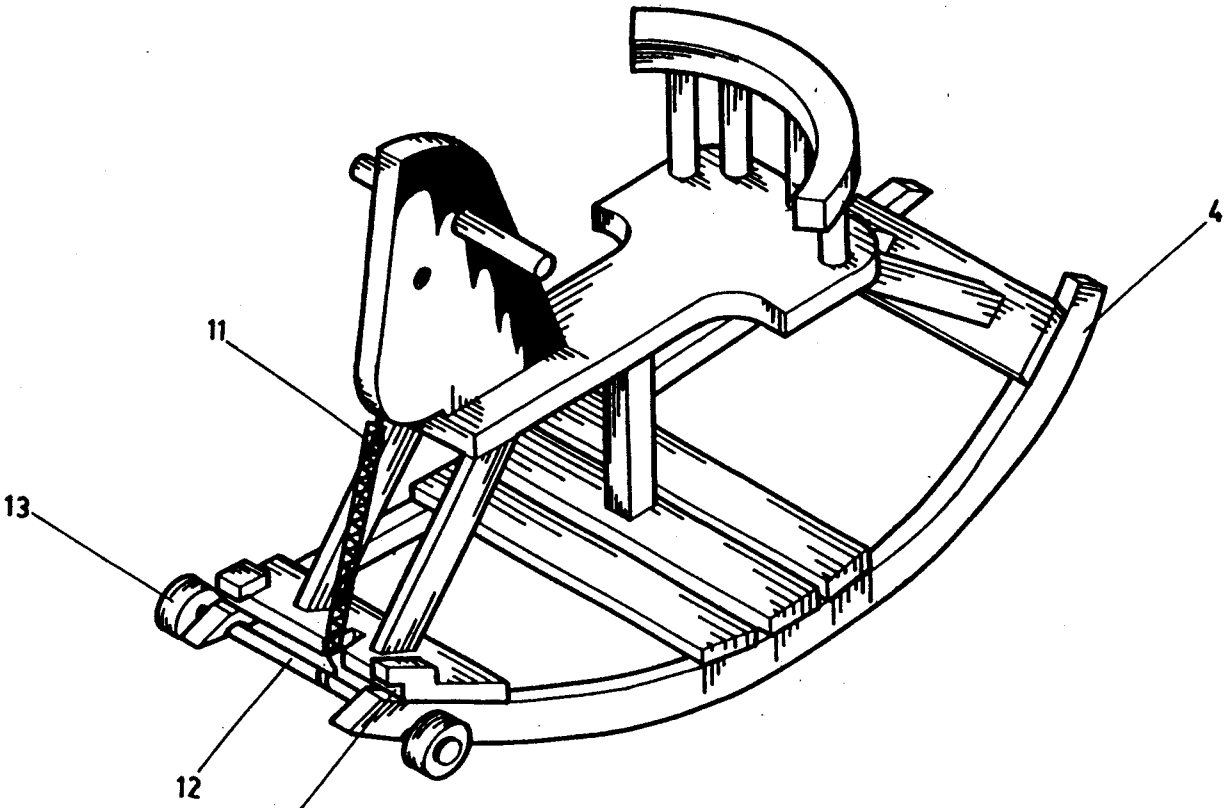
FIG. 2 is a perspective view of the horse with the axle shown engaged within the pair of lower grooves in the rocker arms.
Figure 3:
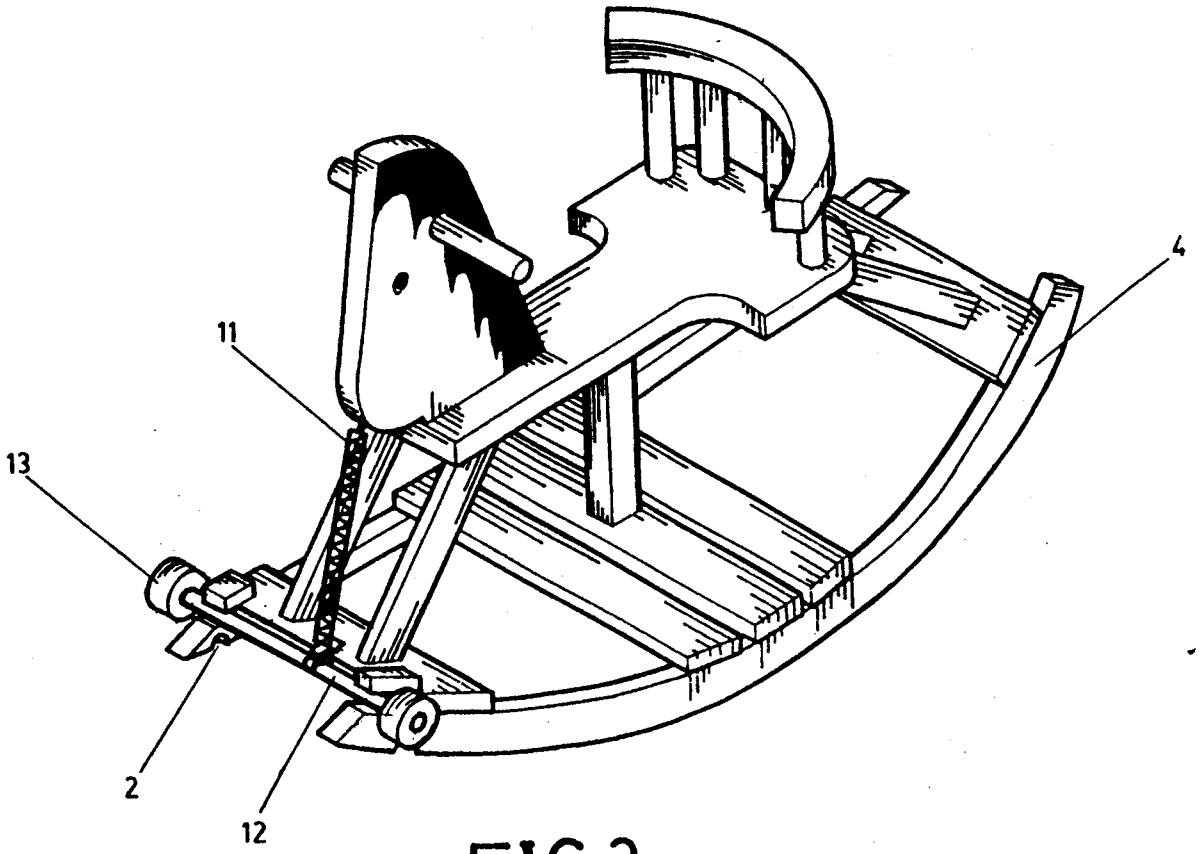
FIG. 3 is a perspective view of the horse shown with the axle engaged within the upper grooves of the rocker arms.

With initial reference to FIGS. 1–3, there is shown a rocking horse according to a preferred embodiment of the invention. The horse is provided with a buffer assembly 1 at its front end. A pair of spaced lower grooves 2 are formed in the bottom edges of a pair of spaced rocker arms 4 which define the base of the horse. A pair of spaced upper grooves 3 are formed at the top of arms 4. Buffer assembly 1 includes an elastic rope 11 having an upper end secured to the head of the horse forming part of the user support means and a lower end secured to an axle 12. A pair of spaced wheels 13 are mounted at the opposite ends of axle 12.

As shown in FIG. 2, axle 12 may be selectively engaged within either lower grooves 2 or upper grooves 3 and maintained in either position by the tension of elastic rope 1.

When axle 12 is secured within lower grooves 2, the user may ride on the horse and cause it to rock back and forth in a stationary position. In the event the rocking motion causes the center line of the horse to approach its declination line, wheels 13 engage the support surface, thereby the horse from rolling or turning over. When the latter occurs, wheels 13 then roll forwardly so that the forward velocity of the horse caused by the rocking motion is buffered and the horse is caused to move in a forward direction. This dissipates the forward velocity resulting from the rocking, thereby preventing the horse from rolling or turning over and affording security to the user.

Figure 4:
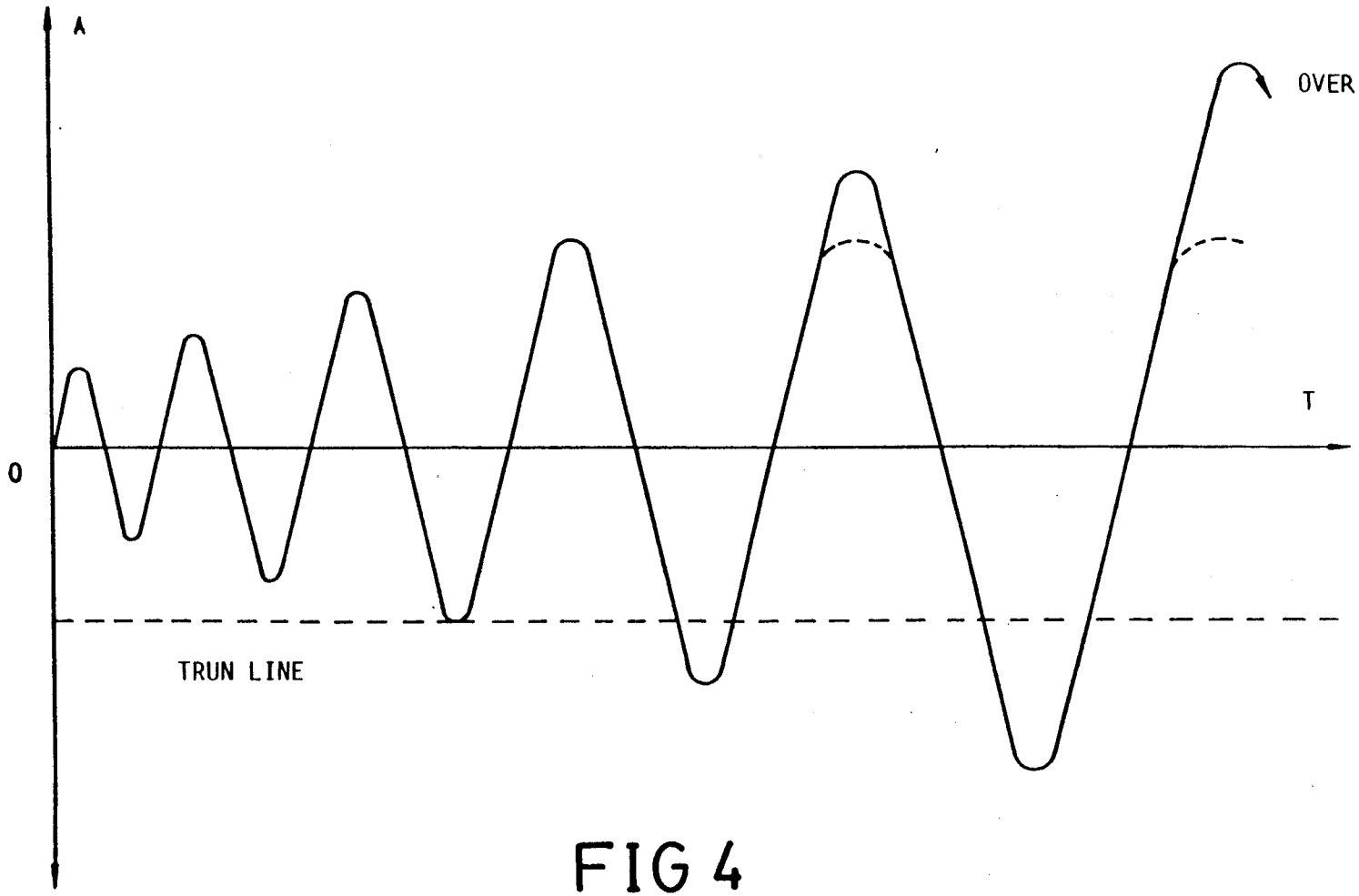
FIG. 4 is a comparative rocking amplitude curve chart.

As seen in FIG. 4, the horse rocks from point O, and will turn or roll over as the rocking velocity increases to the point designated OVER. However, the presence of wheels 13 of buffer assembly 1 will result in a rocking velocity curve indicated by the dotted lines which, in effect, indicates that any forward velocity of the horse from rocking to a certain point will be converted into forward motion through the buffering effect of assembly 1 and thereby provide security to the user.

In the event the user is desirous of rocking the horse in a conventional manner without the center line of the horse exceeding the declination line thereof, axle 12 may be engaged within upper grooves, 3, thereby removing wheels 13 from possible engagement with the support surface. In this configuration, the horse is only permitted to rock back and forth in a stationary location and cannot move in forward direction.

I claim:

1. A safety rocking horse comprising:

(a) a user support means;

(b) a pair of rocker arms for engaging a support surface and forward and rearward ends, and the user support means being mounted on the rocker arms;

(c) the forward ends of the rocker arms being provided with upper groove means and lower groove means;

(d) a buffer assembly including an axle, wheel means supported on the axle and an elastic rope, one of end of the elastic rope being secured to the user support means and another end of the elastic rope being secured to the axle;

(e) the axle being selectively engageable within either the upper groove means or the lower groove means and maintained in either position of engagement under tension of the elastic rope; and (f) whereby when the axle is engaged in the lower groove means and rocking of the horse by the user causes the center line of the horse to approach its declination line, the wheel means engages the support surface to dissipate the forward velocity of the horse and cause the horse to move forwardly along the support surface, thereby preventing the horse from turning over.

* * * * *